US009521914B2

(12) United States Patent
Alvarez

(10) Patent No.: US 9,521,914 B2
(45) Date of Patent: Dec. 20, 2016

(54) LATCH MECHANISM FOR DISPENSING OBJECTS IN POINT OF SALE SYSTEMS

(71) Applicant: MagNet Kiosks Inc., Lexington, MA (US)

(72) Inventor: Eduardo Alvarez, Lexington, MA (US)

(73) Assignee: MagNet Kiosks Inc., Lexington, MA (US)

( * ) Notice: Subject to any disclaimer, the term of this patent is extended or adjusted under 35 U.S.C. 154(b) by 0 days.

(21) Appl. No.: 14/923,467

(22) Filed: Oct. 27, 2015

(65) Prior Publication Data

US 2016/0135618 A1 May 19, 2016

Related U.S. Application Data

(60) Provisional application No. 62/079,274, filed on Nov. 13, 2014.

(51) Int. Cl.

| | |
|---|---|
| ***A47F 10/02*** | (2006.01) |
| ***A47F 1/08*** | (2006.01) |
| ***A47F 1/12*** | (2006.01) |
| ***E05C 3/12*** | (2006.01) |
| ***A47F 1/10*** | (2006.01) |

(52) U.S. Cl.

CPC ..... *A47F 10/02* (2013.01); *A47F 1/08* (2013.01); *A47F 1/10* (2013.01); *A47F 1/12* (2013.01); *E05C 3/12* (2013.01)

(58) Field of Classification Search

CPC ..... G03B 9/08; G03B 17/38; A47F 10/02; A47F 1/12; A47F 1/08; A47F 1/10; E05C 3/12

USPC ..... 211/59.2

See application file for complete search history.

(56) References Cited

U.S. PATENT DOCUMENTS

| | | | | |
|---|---|---|---|---|
| 5,629,662 A | | 5/1997 | Floyd et al. | |
| 5,792,279 A | * | 8/1998 | Tsuboi | H02J 7/355 136/245 |
| 6,011,999 A | | 1/2000 | Holmes | |
| 6,096,969 A | * | 8/2000 | Fujita | H02S 30/20 136/245 |
| 6,459,855 B1 | * | 10/2002 | Kosaka | G03B 9/08 396/176 |
| 8,341,958 B2 | | 1/2013 | Brown et al. | |
| 8,457,784 B2 | | 6/2013 | Rahilly et al. | |

(Continued)

FOREIGN PATENT DOCUMENTS

| | | | |
|---|---|---|---|
| JP | 2003314101 A | * | 11/2003 |
| JP | 2008245143 A | * | 10/2008 |

OTHER PUBLICATIONS

PCT-US 15/57443 International Search Report and Written Opinion, mailed Jan. 21, 2016, for related case. Six pages.

(Continued)

*Primary Examiner* — Korie H Chan

(74) *Attorney, Agent, or Firm* — HoustonHogle LLP

(57) ABSTRACT

A point of sale system including a compartment array for dispensing objects. Each compartment of the compartment array preferably includes a door and a latch mechanism for opening each door. In a preferred embodiment, the latch mechanism includes counterbalanced wires of shape memory alloy material that function as an actuator for opening the door of each compartment in response to selection of an object in that compartment.

12 Claims, 10 Drawing Sheets

(56) References Cited

U.S. PATENT DOCUMENTS

| | | | | |
|---|---|---|---|---|
| 2002/0189612 | A1* | 12/2002 | Rand | A61M 15/0028 128/200.23 |
| 2008/0217927 | A1* | 9/2008 | Browne | E05B 47/0009 292/28 |
| 2008/0288105 | A1 | 11/2008 | Mauger et al. | |
| 2012/0271453 | A1 | 10/2012 | Alvarez | |
| 2013/0320820 | A1* | 12/2013 | Rahilly | E05B 65/46 312/209 |

OTHER PUBLICATIONS

"Latching assembly uses nitinol memory wire to drive latch/unlatch function," www.autosplice.com, Aug. 12, 2013.

* cited by examiner

LATCH MECHANISM FOR DISPENSING OBJECTS IN POINT OF SALE SYSTEMS

RELATED APPLICATIONS

This application claims the benefit under 35 U.S.C. 119(e) of U.S. Provisional Application No. 62/079,274, filed on Nov. 13, 2014, which is incorporated herein by reference in its entirety A portion of the disclosure of this patent document contains material that is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE INVENTION

Point of sale systems, such as vending machines and retail kiosks, include various mechanisms to dispense objects selected by consumers. Current dispensing mechanisms include motorized rotatable helical feeder coils or carousels that include the objects, robotic arms, servos, and solenoid actuators that push or move the objects, and motorized mechanisms that open normally closed doors of compartments including the objects, in examples.

SUMMARY OF THE INVENTION

Current systems and methods for dispensing objects in point of sale systems have problems. They are typically bulky and complex, and require multiple electrical and mechanical components. This increases cost and reduces reliability. In addition, the number and types of components required can increase the weight and overall size/form factor of the point of sale system, and can increase its power requirements. This restricts the types of retail outlets and locations in which the point of sale systems such as retail kiosks can be deployed.

In contrast, the present invention provides a micro latch dispensing mechanism for dispensing the objects. An individual latch mechanism is preferably integrated within each compartment of a compartment array, where each compartment in the array includes an object. The latch mechanism occupies a small fraction of the volume of each compartment and uses fewer components than current dispensing systems and methods. The reduced complexity and relative simplicity of the latch mechanism makes the system more reliable, less expensive to produce, and easier to miniaturize than current systems and methods.

The small form factor of the latch mechanisms also allows the latch mechanisms to be included within a thin printed circuit board or other encasement that simplifies connections and optimizes space. The encasements, in turn, can be integrated with the compartments of the compartment array. Finally, the compartments themselves can be built or formed from modular components to achieve a desired compartment density and to support different sized compartments for accommodating different size objects.

In general, according to one aspect, the invention features a point of sale system. The point of sale system comprises a compartment array for dispensing objects, and a latch mechanism for each compartment in the compartment array. Each latch mechanism includes a primary wire of shape memory alloy material to function as an actuator, and each actuator is used to open a door of each compartment.

In one implementation, each latch mechanism is included within an encasement integrated within each compartment of the compartment array, where the encasement encapsulates the latch mechanism. The actuator preferably includes a secondary wire of shape memory alloy material that functions as a spring.

Preferably, each latch mechanism for each compartment includes a cam having a back end interposed between the primary wire and a secondary wire of the actuator, and a hook rotatably fastened to the door, where the hook engages with a front end of the cam. The primary wire of the actuator exerts a downward force upon the back end of the cam and the secondary wire of the actuator exerts an upward force upon the back end of the cam for controlling the door of each compartment.

The upward force exerted by the secondary wire of the actuator upon the back end of the cam normally exceeds the downward force exerted upon the back end of the cam by the primary wire of the actuator, associated with a locked position of both the cam and the door.

The primary wire of the actuator accepts a current in response to selection of the object in each compartment. In turn, the current causes the downward force exerted upon the back end of the cam by the primary wire of the actuator to exceed the upward force exerted upon the back end of the cam by the secondary wire of the actuator, which causes the cam to disengage from the hook, associated with an unlocked position of both the cam and the door for dispensing the object.

In general, according to another aspect, the invention features a method for dispensing objects from a point of sale system. The method comprises including the objects within compartments of a compartment array of the point of sale system, wherein each of the compartments includes a normally locked door. The method also comprises a latch mechanism of each compartment including a primary wire of shape memory alloy material to function as an actuator for unlocking the door of each compartment, and in response to selection of an object, the actuator of the latch mechanism unlocking the door of the compartment including the object.

The above and other features of the invention including various novel details of construction and combinations of parts, and other advantages, will now be more particularly described with reference to the accompanying drawings and pointed out in the claims. It will be understood that the particular method and device embodying the invention are shown by way of illustration and not as a limitation of the invention. The principles and features of this invention may be employed in various and numerous embodiments without departing from the scope of the invention.

BRIEF DESCRIPTION OF THE DRAWINGS

In the accompanying drawings, reference characters refer to the same parts throughout the different views. The drawings are not necessarily to scale; emphasis has instead been placed upon illustrating the principles of the invention. Of the drawings.

DETAILED DESCRIPTION OF THE PREFERRED EMBODIMENTS

The invention now will be described more fully hereinafter with reference to the accompanying drawings, in which illustrative embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

As used herein, the term "and/or" includes any and all combinations of one or more of the associated listed items. Further, the singular forms of the articles "a", "an" and "the" are intended to include the plural forms as well, unless expressly stated otherwise. It will be further understood that the terms: includes, comprises, including and/or comprising, when used in this specification, specify the presence of stated features, integers, steps, operations, elements, and/or components, but do not preclude the presence or addition of one or more other features, integers, steps, operations, elements, components, and/or groups thereof. Further, it will be understood that when an element, including component or subsystem, is referred to and/or shown as being connected or coupled to another element, it can be directly connected or coupled to the other element or intervening elements may be present.

Figure 1A:
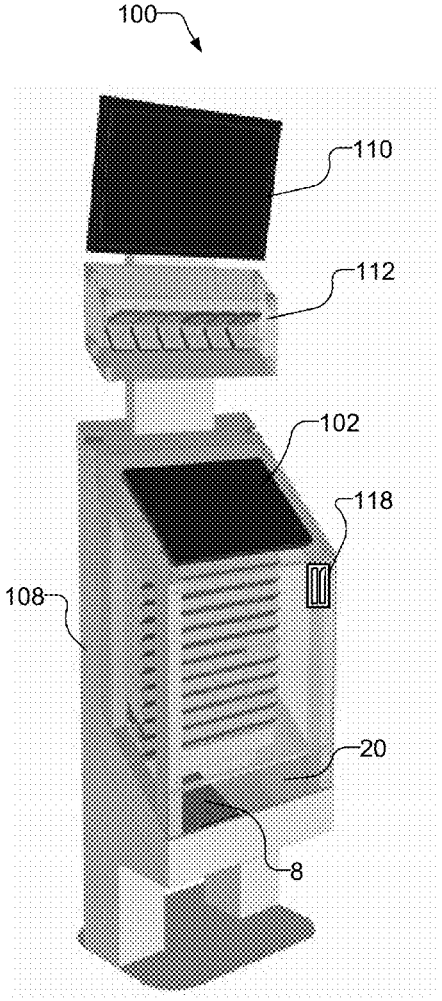
FIGS. 1A and 1B show an exemplary retail kiosk point of sale system that utilizes the inventive latch mechanism for dispensing objects, with FIG. 1A showing the kiosk fully assembled, and with FIG. 1B showing an access door of the kiosk fully open to reveal compartments of a compartment array, where each of the compartments include an inventive latch mechanism.

FIG. 1A is an exemplary retail kiosk point of sale system 100. It includes a main housing 108, a display screen 110, a user interface 102, a product display case 112, and a card reader 118. The display screen 110 welcomes the user and displays video advertisements and targeted advertising messages for upsell capability, in examples.

Users such as consumers select an object 8 using the user interface 102. Preferably, the user interface 102 is a touch screen. The user interface 102 can also display images of the objects and browse detailed product literature associated with the objects. The user interface 102 can also display this information on the display screen 110.

Users pay for the objects via card reader 118 that validates user identity and payment information. In one example, the kiosk 100 can request information directly from the users via the user interface 102 such as email address and telephone number for customer retention and product survey purposes.

In response to user selection of and payment for an object 8, the system 100 dispenses the object 8. The object 8 is dispensed into a dispensing bay 20, from which the user can retrieve the object 8.

Though the point of sale system 100 preferably targets retail outlets and settings, it can be appreciated that the system 100 can also be adapted for settings such as medical and industrial environments, in examples. The systems 100 can be used to dispense controlled medicines and devices in hospitals and pharmacies, and valuable parts or materials in an industrial or scientific setting, in examples. In these settings, the card reader 118 can accept ID badges including user credentials instead of credit card information, in one example. The card reader 118 can then send the credentials to a back office database that provides access only to authorized users or employees. In another example, the system 100 can be integrated with inventory control and tracking of the objects 8. RFID.

Figure 1B:
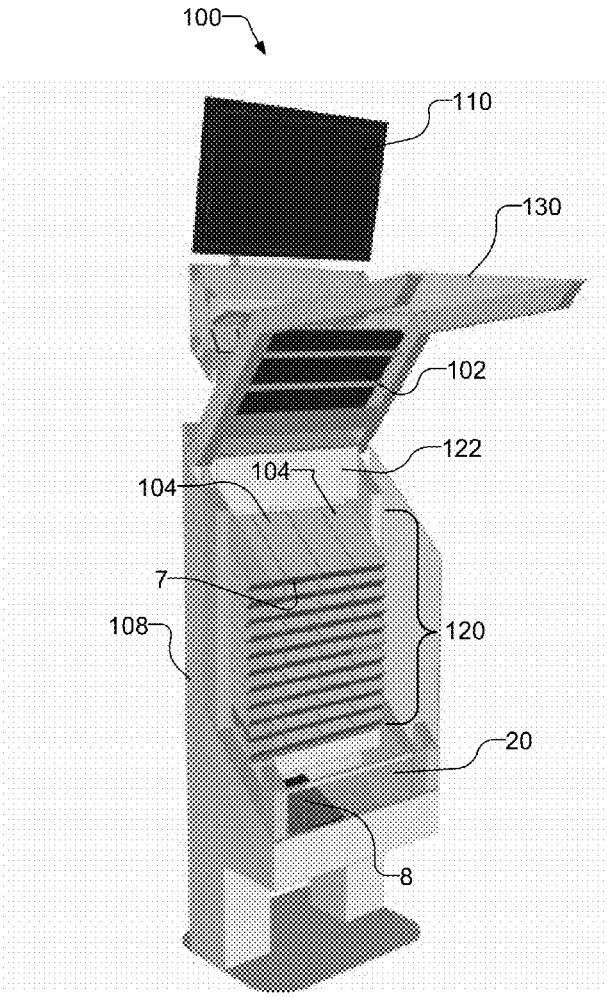

FIG. 1B shows the retail kiosk point of sale system 100 of FIG. 1A, with its kiosk door 130 or hatch of the main housing 108 currently open. Operators open the hatch 130 for restocking of the objects 8. With the hatch 130 open, individual compartments 104 of a compartment array 120 can be seen. Each of the compartments 104 includes an individual object 8. Each compartment 104 also includes a door 7.

Figure 1C:
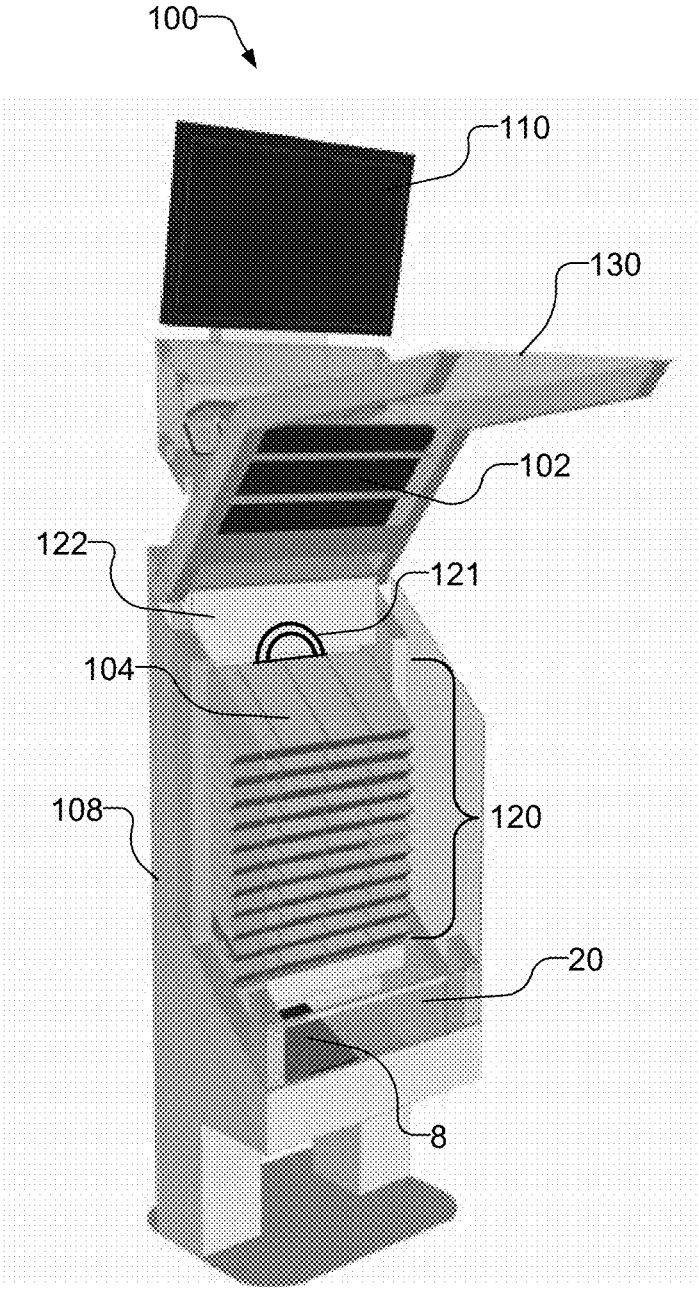
FIG. 1C shows a retail kiosk point of sale system that is similar to that of FIG. 1B, with the compartment array including a handle for modular replacement of the entire compartment array as a unit for restocking purposes.

FIG. 1C shows a retail kiosk point of sale system 100 including a compartment array 120 with a handle 121. For restocking of the objects 8, operators can preferably remove the entire compartment array 120 as a unit via its handle 121 from the main housing 108. Operators can then replace an existing compartment array 120 of empty or substantially empty compartments 104 with a new compartment array 120 that includes objects 8 in each of the compartments 104.

Figure 2:
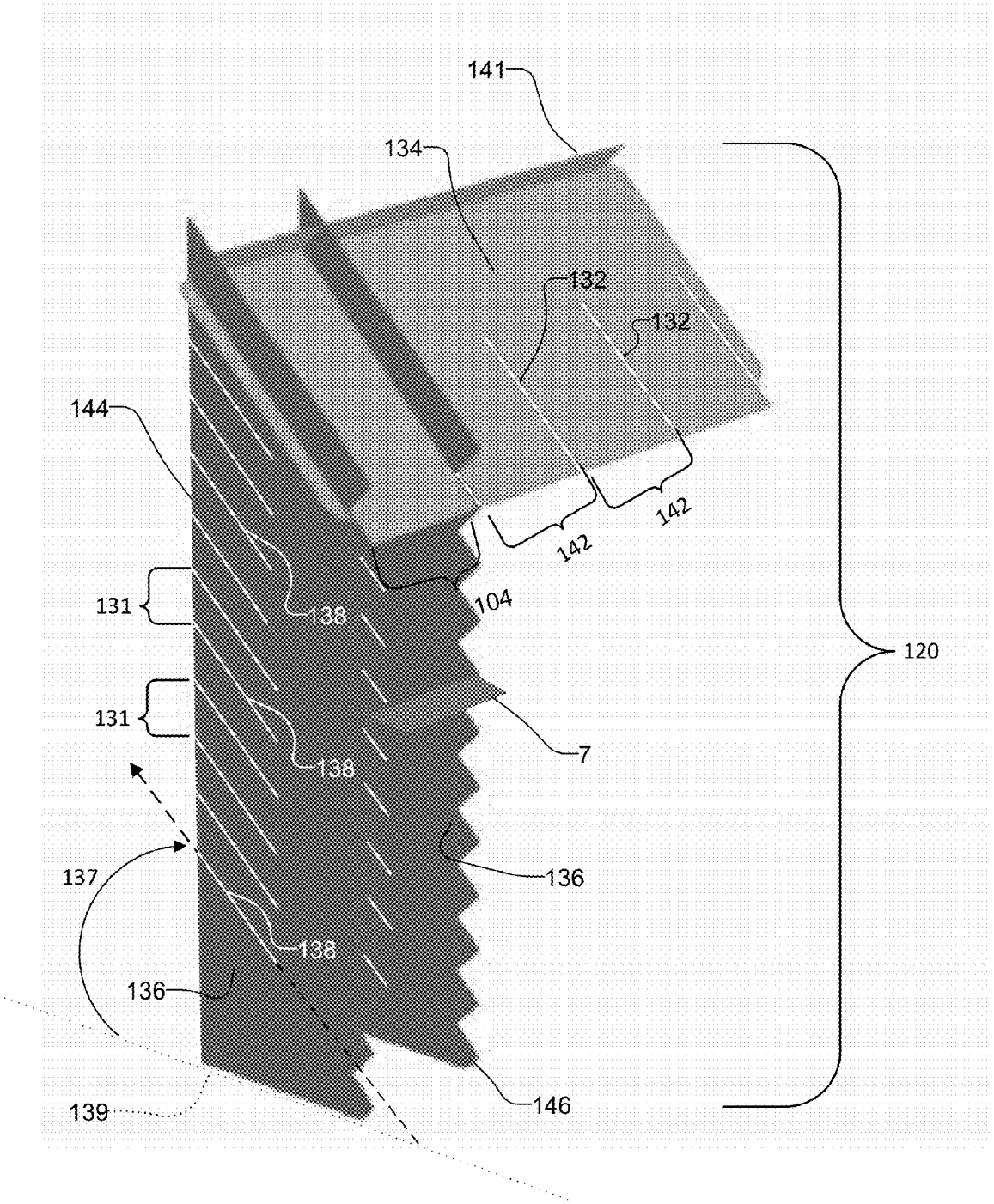
FIG. 2 is a perspective view of a partially assembled compartment array.

FIG. 2 shows a preferred embodiment of the compartment array 120. The compartments 104 of the compartment array 120 are formed by arranging vertical members 136 and horizontal members 134 in a stacked or grid fashion. A top layer or cover of the compartment array 120 is removed to facilitate the description for how the component array 120 is assembled, included herein below.

The vertical members 136, or columns, include slots 138. The slots 138 of the columns 136 are typically cut or stamped such that the distance 131 between adjacent slots 138 is the same. In a similar fashion, the horizontal members 134, or rows, include slots 132. The slots 132 are also typically cut or stamped such that the distance between adjacent slots 132 is the same. The rows 134 and columns 136 are typically sheets of material such as plastic or aluminum, in examples.

Assembly of the compartment array 120 requires aligning the slots 138 of the columns 136 with the slots 132 of the rows 134. The rows 134 are preferably inserted from a back end 144 of the columns 136 towards a front end 146 of the columns 136. The rows 134 include a header flange 141 that allows the rows 134 to seat within the columns 136 once each row is fully inserted. The rows 134 seat within the columns 136 when the header flange 141 of each row 134 meets the back end 144 of the columns 136. As a result of stacking successive rows 134 within the columns 136, the compartments 104 of the compartment array 120 are formed between adjacent rows 134 and columns 136.

By adding or removing columns 136 and/or rows 134 from the component array 120, operators can change the number of compartments 104 and their sizes in accordance with their business needs. In examples, compartment arrays 120 can include hundreds of compartments 104 of potentially different sizes, each of which includes objects 8 that can be individually dispensed on demand.

Each of the compartments 104 has a door 7, only one of which is shown. The doors 7 preferably fasten between adjacent columns 136. The doors are located at the front end 146 of the columns 136. The doors 7 of each compartment 104 are normally closed or locked, which secures its associated object 8. Preferably, operators restock the objects 8 for each compartment 104 by loading the objects 8 into each compartment 104 from the front end 146 of the columns 136 that form the component array 120. In another example, the compartments 104 can be open at the back end 144 of the columns 136, enabling loading of the objects 8 from the back of the compartments 104.

The slots 138 of the columns 136 are preferably oriented at an acute angle 137 with respect to the plane of the floor 139 upon which the kiosk 100 stands. The angle 137 is measured from the plane of the floor 139 to lines projected from the slots 138, in a direction towards the back end 144 of the columns 136. As a result, the front end 146 of the columns 136 for each compartment 104 are slanted down relative to the back end 144 of the columns by the acute angle 137. Correspondingly, when a door 7 of a compartment 104 is opened in response to user selection of the object 8 in its compartment 104, the object 8 falls out the front end 146 of the compartments/columns by gravity.

Figure 3:
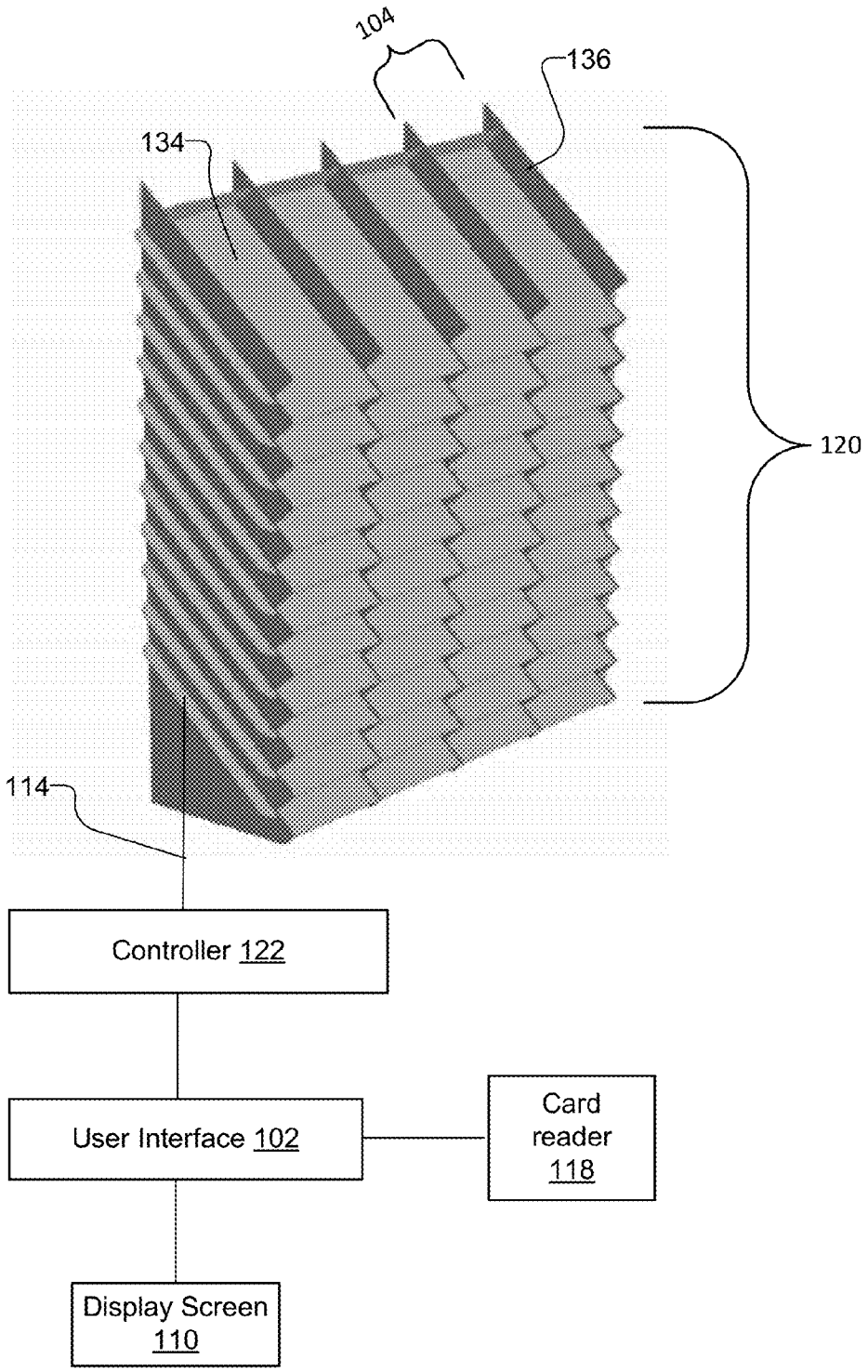
FIG. 3 is a block diagram of the major components of the retail kiosk in FIG. 1A through FIG. 1C.

FIG. 3 shows high-level components of the retail kiosk 100 that participate in selection and dispensing of objects 8. The components include a compartment array 120, a controller 122, a user interface 102, a card reader 118, and a display screen 110. In FIG. 3, the compartment array 120 is shown fully assembled.

The columns 136 typically include electronics to identify their configuration and connect with other columns. Preferably, only one of the columns 136 is connected to the controller 122. The controller 122 identifies the configuration of all of the columns 136 and interfaces with the user interface 102.

The controller 122 verifies selection of objects 8 by the user on the user interface 102 and payment from the card reader 118. In response to a valid selection and payment verification, the controller 122 sends a signal (114) to the compartment (104) including the selected object 8. Typically, the controller 122 is a computing device such as a microprocessor with a software interface. The software interface allows operators to reprogram the controller 122 in response to reconfiguring the number or size of the compartments 104 in the compartment array 120, and to administratively enable or disable the compartments 104, in examples.

Figure 4:
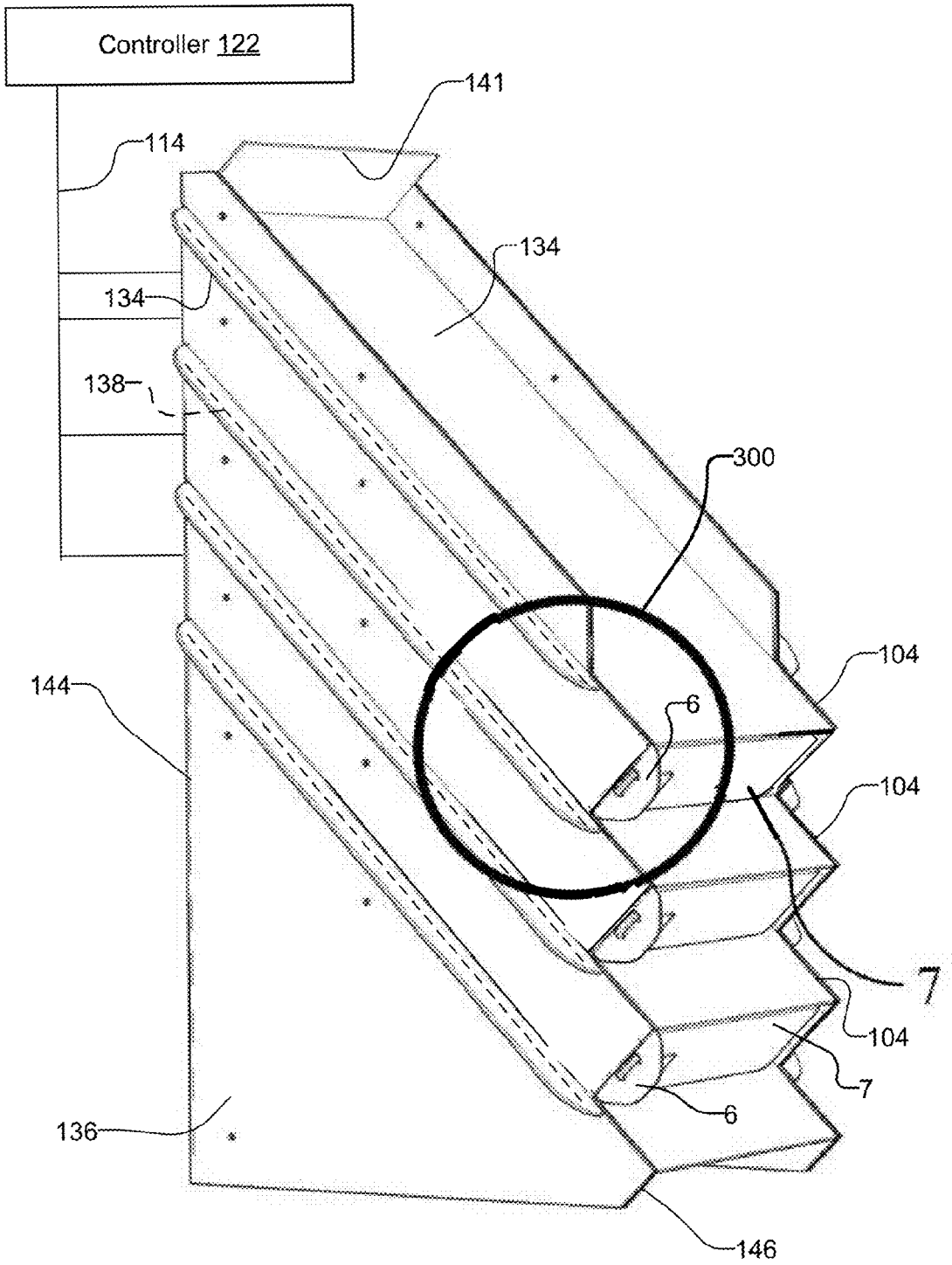
FIG. 4 is a cross-section of the compartment array, showing a column of three compartments that hold objects to be dispensed, and showing the doors of the compartments in in a normally closed state.
Figure 5:
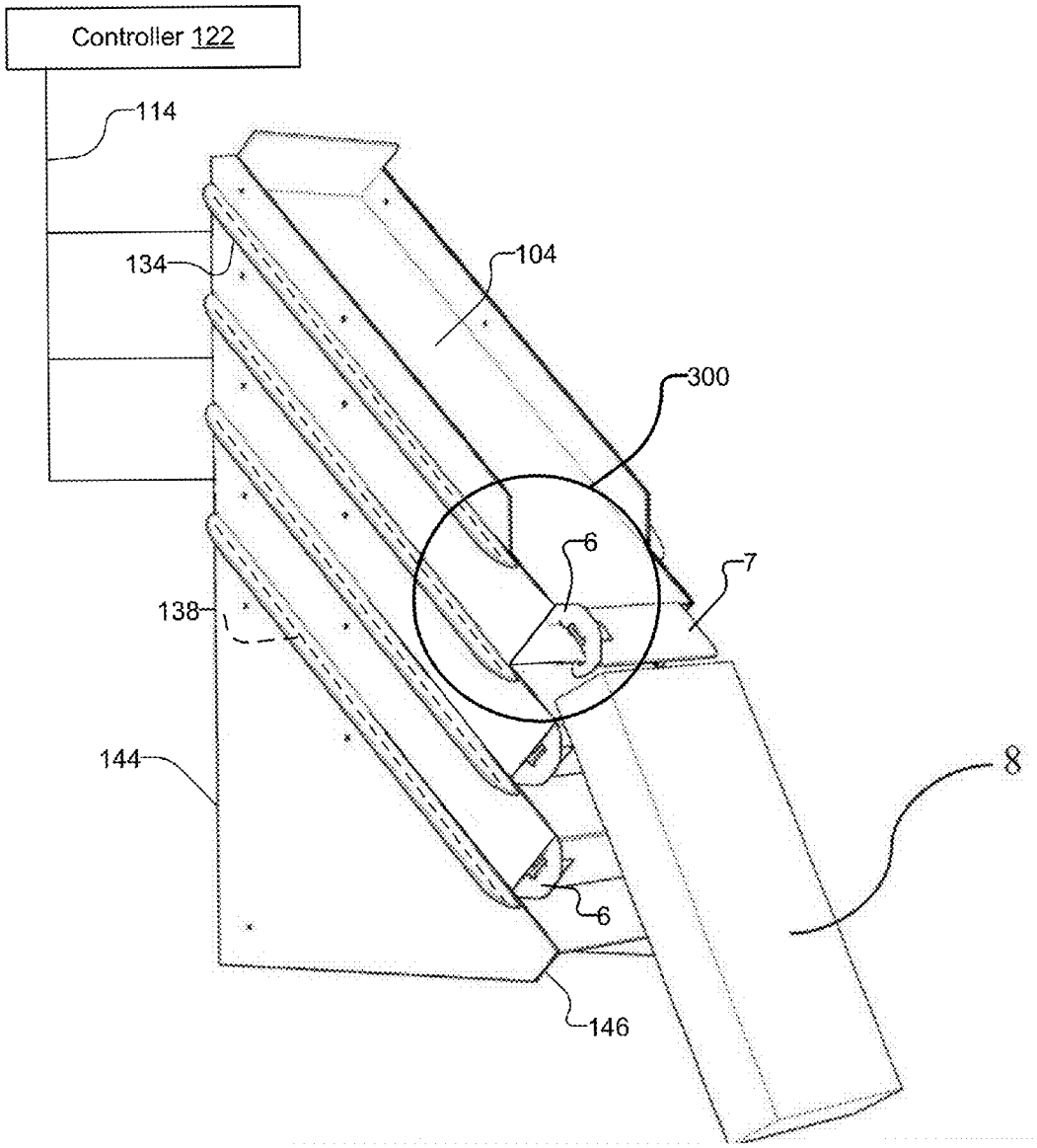
FIG. 5 is a cross-section of the compartment array as shown in FIG. 4, additionally showing one of the doors of the compartments in an open state and dispensing an object.

FIG. 4 and FIG. 5 show a cross-section of the compartment array 120. The cross-section includes three compartments 104. Each compartment 104 has a door 7. Each compartment 104 also has a hook 6 that controls opening and closing of the door 7 of each compartment 104. Each compartment 104 is also electrically coupled to the controller 122. FIG. 4 and FIG. 5 provide an area of detail 300 associated with one of the compartments 104.

Figure 6:
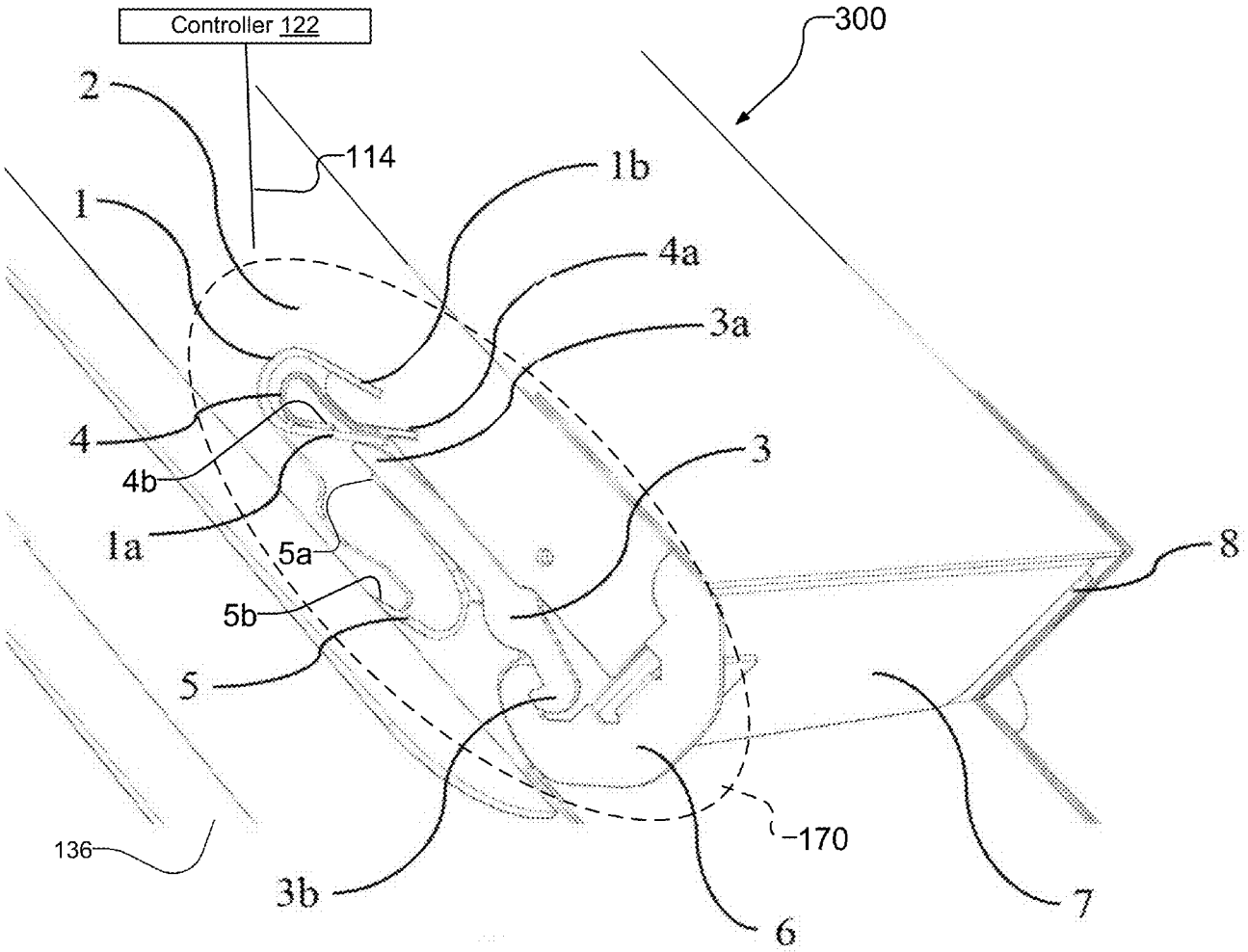
FIG. 6 is an enlarged perspective view of the encircled portion in FIG. 4, showing internal components of the inventive latch mechanism within a compartment, and showing the latch mechanism in a normally closed state.
Figure 7:
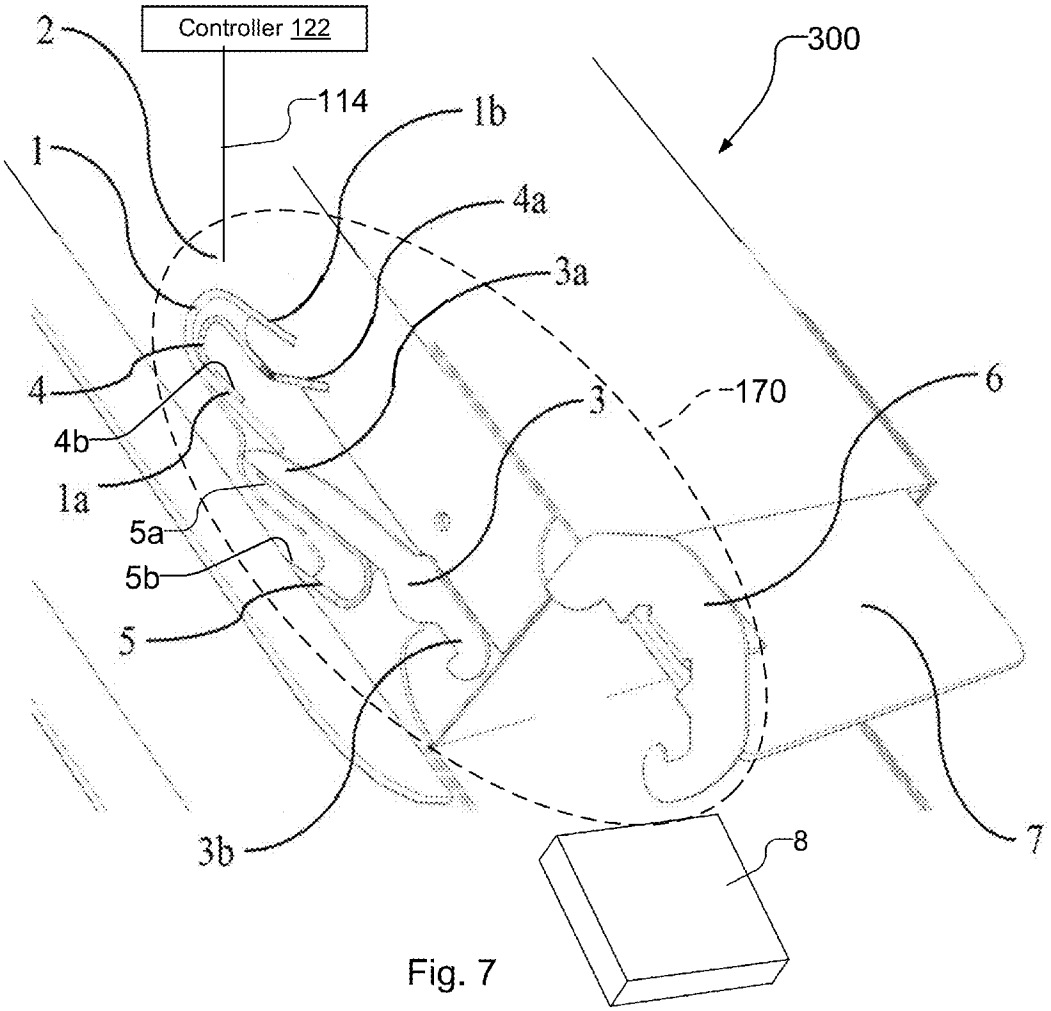
FIG. 7 is an enlarged perspective view of the encircled portion in FIG. 5, showing internal components of the inventive latch mechanism within a compartment, and showing the latch mechanism in an open state and dispensing an object.

The area of detail 300 in FIG. 4 is associated with a compartment 104 with a closed door 7. The area of detail 300 in FIG. 5 is associated with a compartment 104 with an open door 7. FIG. 6 and FIG. 7 provide detail for internal components within the area of detail 300 of FIG. 4 and FIG. 5, respectively.

FIG. 6 shows latch mechanism 170 in its steady-state or normally closed state. Preferably, each latch mechanism is included within an encasement 2. Typically, the encasement 2 is a sheet laminate of a nonconductive synthetic resin or printed circuit board (PCB) material such as fiberglass or bakelite, in examples. As its name implies, the encasement 2 surrounds or encapsulates the latch mechanism 170 to insulate and protect it from unwanted electrical stimuli and environmental conditions.

The columns 136 typically include as many encasements 2/latch mechanisms 170 as slots 138. The encasements 2 are preferably integrated within the columns 136 near the front end 146 of the columns 136. As a result, the columns 136 include a latch mechanism 170 for each compartment 170 of the compartment array 120. Each latch mechanism 170 is electrically coupled to controller 122 via the encasement 2 of each latch mechanism 170.

Each latch mechanism 170 preferably includes a primary wire 1, a locking cam 3, a flexible electrical conductor 4, a secondary wire 5, and a door hook 6. The cam 3 has a front end (3*b*) and a back end (3*a*).

The primary wire 1 and the secondary wire 5 exert opposing tensile forces upon the back end (3*a*) of the cam 3. The secondary wire 5 functions as a spring.

According to a preferred embodiment, the primary wire 1 and secondary wire 5 are preferably made of a shape memory alloy (SMA) such as Nitinol, a nickel/titanium alloy. Shape memory alloys have a flexibility that changes with temperature. The temperature at which the flexibility of SMAs such as Nitinol change is called the transformation temperature.

When heated, shape memory alloys become stiffer. Heating above the transformation temperature recovers the original shape of the material and converts it to its higher tensile strength condition. When cooled, shape memory alloys become more flexible again. This property allows SMAs to function as actuators.

The counterbalanced primary wire 1 and secondary wire 5 of the latch mechanism 170 function as an actuator to the cam 3. This type of actuator takes up much less space than servo motor drive and solenoid based actuators of current dispensing systems and methods.

The primary wire 1 has a fixed end (1*b*) and a free end (1*a*) that moves. The fixed end (1*b*) is directly soldered to the encasement 2 to provide an electrical connection to the primary wire 1. The flexible conductor 4 has a fixed end (4*b*) and a free end (4*a*) that moves. The secondary wire 5 also has a fixed end (5*b*) and a free end (5*a*) that moves. The secondary wire 5 has a passive function and has no electrical connection.

The free end (1*a*) of the primary wire 1 is soldered to the free end (4*a*) of the flexible conductor 4. The fixed end (4*b*) of the flexible conductor 4 is also soldered to the encasement 2 to provide an electrical connection to the flexible conductor 4.

The primary wire (1) is bent within its elasticity limits into a "U" shape inside the encasement (2). The free end (1*a*) of the primary wire (1) engages with and exerts a downward force upon the back end (3*a*) of the cam 3. Secondary wire (5) is also bent in a "U" shape, and is located in an opposite position to the primary wire 1 within the encasement 2. The fixed end (5*b*) of the secondary wire 5 is secured to the encasement 2. The free end (5*a*) of the secondary wire 5 engages with and exerts an upward force upon the back end (3*a*) of the cam 3. The front end (3*b*) of the cam 3 engages with hook 6. Hook 6, in turn, is rotatably fastened to door 7.

In FIG. 6, cam 3 is in its normally closed or locked position. The cam 3 is in its locked position when operators close the door 7 after restocking its compartment 104 with an object 8. As the door 7 closes, the door hook 6 rotates inward towards the compartment 104 until the door hook 6 engages with the front end (3*b*) of the cam 3. This places the cam 3 in its locked position.

The cam 3 remains in its normally closed or locked position because of the opposing forces placed upon the back end (3*a*) of the cam 3 by the primary 1 and secondary 5 wires, and because of the length and position of the secondary wire 5 relative to the primary wire 1. The secondary wire 5 normally exerts a stronger force upwards upon the back end of the cam (3) than the force exerted downward upon the back end (3*a*) of the cam (3) by the primary wire 4. Because the cam 3 remains in its normally closed state, the latch mechanism 170 also remains in its normally closed state, and the door 7 of the compartment 104 remains in its closed or locked position.

FIG. 7 shows the latch mechanism 170 in its open or unlocked state. To unlock the latch mechanism 170, in response to a user selection of an object 8, the controller 122 sends an electrical current 114 to a wire of the encasement 2 of the compartment 104 that holds the selected object 8. The fixed end (1*b*) of the primary wire 1 is electrically coupled to the wire of the encasement 2.

The electrical current 114 applied to the primary wire 1 causes the primary wire 1 to heat up and change its shape. As the primary wire 1 heats, it deforms and becomes stiffer, causing its free end (1*a*) to move. As the free end (1*a*) moves, it increasingly exerts a greater downward force upon the back end (3*a*) of the cam 3.

When the downward force exerted upon the back end (3*a*) of the cam 3 becomes larger than the upward force exerted to the back end (3*a*) of the cam 3 by the secondary wire 5, the cam (3) rotates to its "unlocked" position, which disengages the door hook 6 from the front end (3*b*) of the cam 3. As a result, the door 7 opens, and dispenses the object 8.

As the primary wire 1 cools, it becomes more elastic and returns to its steady-state. This causes the upward force of the secondary wire 5 upon the back end (3*a*) of the cam 3 to predominate. In response, the cam 3 rotates back to its normally closed or locked position. The door 7 remains open, requiring the operator to manually close the door to re-engage the door hook 6 with the cam 3.

Figure 8:
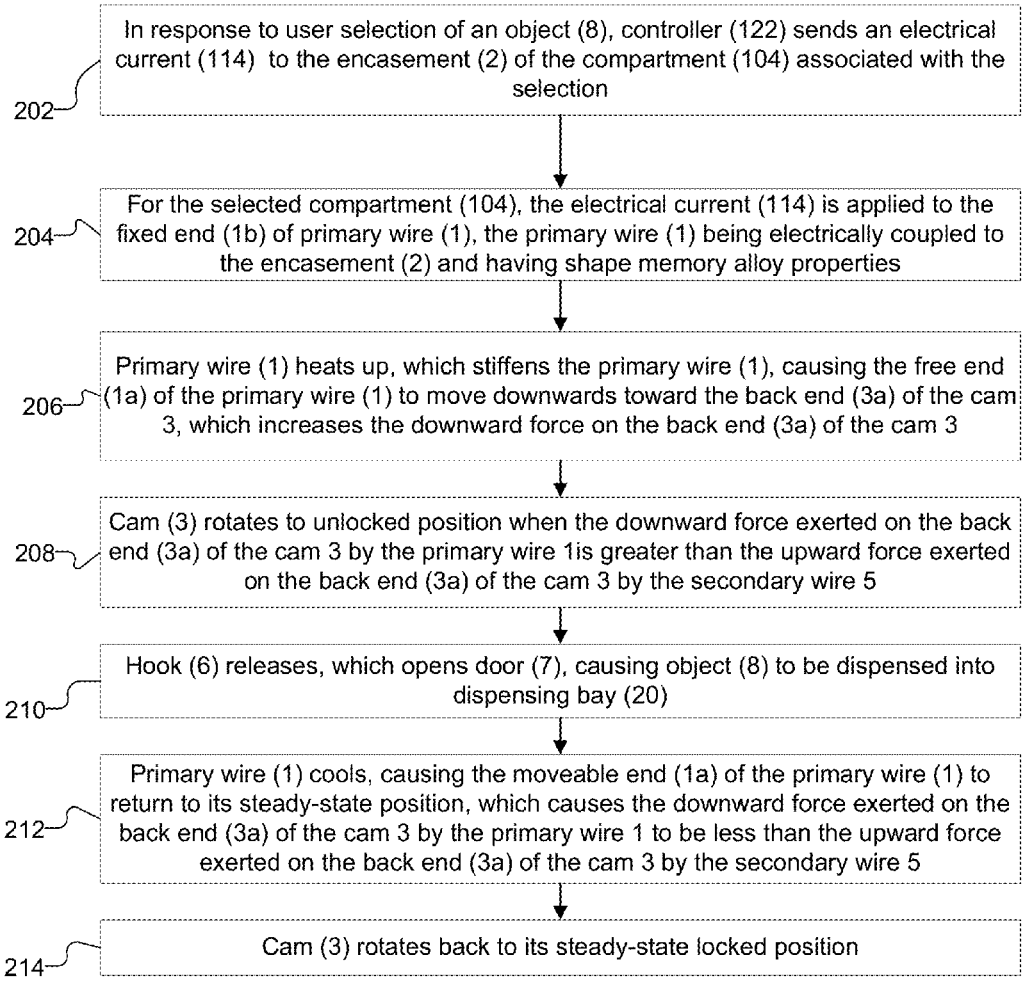
FIG. 8 is a flow chart that shows a method of operation for the inventive latch mechanism according to a preferred embodiment.

FIG. 8 is a method of operation for the inventive latch mechanism 170. Preferably, the latch mechanism 170 is included within a compartment 104 of a compartment array 120 of the exemplary retail kiosk system 100.

In step 202, in response to user selection of an object 8, controller 122 sends an electrical current 114 to the encasement 2 of the compartment 104 associated with the selection. In step 204, for the selected compartment (104), the electrical current (114) is applied to the fixed end (1*b*) of primary wire (1), the primary wire (1) being electrically coupled to the encasement (2) and having shape memory alloy properties.

According to step 206, primary wire (1) heats up, which stiffens the primary wire (1), causing the free end (1*a*) of the primary wire (1) to move downwards toward the back end (3*a*) of the cam 3, which increases the downward force on the back end (3*a*) of the cam 3.

Then, in step 208, cam (3) rotates to unlocked position when the downward force exerted on the back end (3*a*) of the cam 3 by the primary wire 1 is greater than the upward force exerted on the back end (3*a*) of the cam 3 by the secondary wire 5. As a result, hook (6) releases, which opens door (7), causing object (8) to be dispensed into dispensing bay (20), in step 210.

In step 212, primary wire (1) cools, causing the moveable end (1*a*) of the primary wire (1) to return to its steady-state position, which causes the downward force exerted on the back end (3*a*) of the cam 3 by the primary wire 1 to be less than the upward force exerted on the back end (3*a*) of the cam 3 by the secondary wire 5. Cam (3) then rotates back to its steady-state locked position in step 214.

Figure 9:
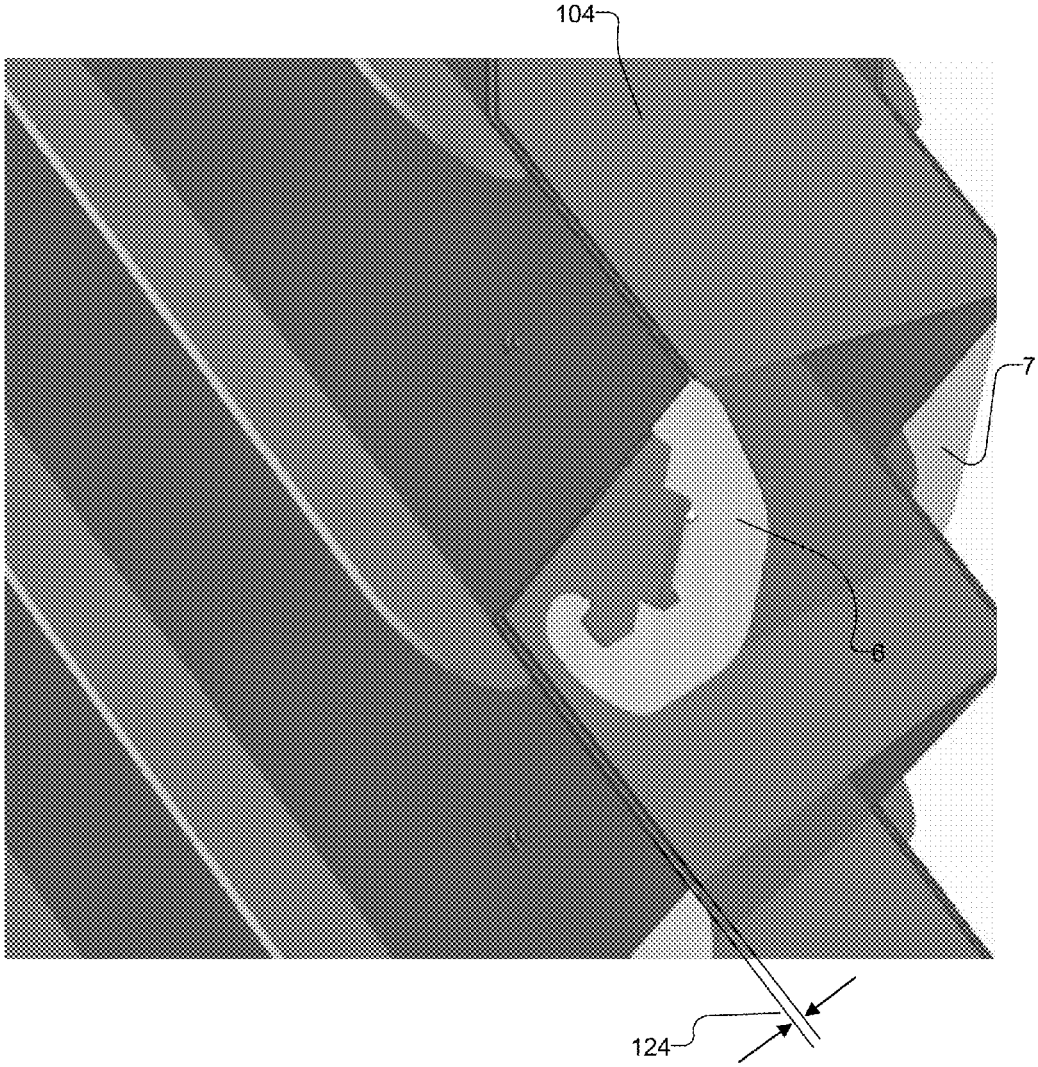
FIG. 9 is a perspective view of a compartment, showing a nominal thickness of an encasement that includes the latch mechanism.

FIG. 9 shows a nominal thickness 124 of the encasement 2 relative to each compartment 104. Preferably, the thickness 124 is on the order of 3 mm. This provides an example of the small form factor of the latch mechanism 170.

While this invention has been particularly shown and described with references to preferred embodiments thereof, it will be understood by those skilled in the art that various changes in form and details may be made therein without departing from the scope of the invention encompassed by the appended claims.

What is claimed is:

1. A point of sale system, comprising:

a compartment array for dispensing objects; and a latch mechanism for each compartment in the compartment array, wherein each latch mechanism includes a primary wire of shape memory alloy material to function as an actuator and a secondary wire, and wherein each actuator is used to open a rotatable door of each compartment;

wherein each latch mechanism for each compartment further includes:

a cam haying a back end interposed between the primary wire and the secondary wire of the actuator, the primary wire of the actuator exerting a downward force upon the back end of the cam and the secondary wire of the actuator exerting an upward force upon the back end of the cam for controlling the rotatable door of each compartment; and a hook fastened to the rotatable door, wherein the hook engages with a front end of the cam.

2. The system of claim 1, wherein each latch mechanism is included within an encasement integrated within each compartment of the compartment array, and wherein the encasement encapsulates the latch mechanism.

3. The system of claim 1, wherein the secondary wire includes shape memory alloy material.

4. The system of claim 1, wherein the secondary wire functions as a spring.

5. The system of claim 1, wherein the upward force exerted by the secondary wire of the actuator upon the back end of the cam normally exceeds the downward force exerted upon the back end of the cam by the primary wire of the actuator, associated with a locked position of both the cam and the door.

6. The system of claim 1, wherein the primary wire of the actuator accepts a current in response to selection of the object in each compartment, and wherein the current causes the downward force exerted upon the back end of the cam by the primary wire of the actuator to exceed the upward force exerted upon the back end of the cam by the secondary wire of the actuator, which causes the cam to disengage from the hook, associated with an unlocked position of both the cam and the door for dispensing the object.

7. A method for dispensing objects from a point of sale system, the method comprising:

including the objects within compartments of a compartment array of the point of sale system, wherein each of the compartments includes a normally locked rotatable door;

a latch mechanism of each compartment including a primary wire of shape memory alloy material to function as an actuator for unlocking the rotatable door of each compartment and a secondary wire; and in response to selection of an object, the actuator of the latch mechanism unlocking the rotatable door of the compartment including the object in which a cam has a back end interposed between the primary wire and the secondary wire of the actuator and a hook is fastened to the rotatable door, the hook engaging with a front end of the cam with the primary wire of the actuator and exerting a downward force upon the back end of the cam and the secondary wire of the actuator exerting an upward force upon the back end of the cam for controlling the rotatable door of each compartment.

8. The method of claim 7, wherein each latch mechanism is included within an encasement integrated within each compartment of the compartment array, and wherein the encasement encapsulates the latch mechanism.

9. The method of claim 7, wherein the secondary wire has shape memory alloy material.

10. The method of claim 7, wherein the secondary wire functions as a spring.

11. The method of claim 7, wherein the upward force exerted by the secondary wire of the actuator upon the back end of the cam normally exceeds the downward force exerted upon the back end of the cam by the primary wire of the actuator, associated with a locked position of both the cam and the door.

12. The method of claim 11, wherein the primary wire of the actuator accepts a current in response to selection of the object in each compartment, and wherein the current causes the downward force exerted upon the back end of the cam by the primary wire of the actuator to exceed the upward force exerted upon the back end of the cam by the secondary wire of the actuator, which causes the cam to disengage from the hook, associated with an unlocked position of both the cam and the door for dispensing the object.

* * * * *